US005310308A

United States Patent [19]

Yu et al.

[11] Patent Number: 5,310,308

[45] Date of Patent: May 10, 1994

[54] AUTOMOTIVE FUEL PUMP HOUSING WITH ROTARY PUMPING ELEMENT

[75] Inventors: Dequan Yu; Henry W. Brockner, both of Ann Arbor, Mich.

[73] Assignee: Ford Motor Company, Dearborn, Mich.

[21] Appl. No.: 131,223

[22] Filed: Oct. 4, 1993

[51] Int. Cl.[5] ..... F04D 5/00

[52] U.S. Cl. ..... 415/55.6; 415/55.2; 415/55.7

[58] Field of Search ..... 415/55.2, 55.5, 55.6, 415/55.7

[56] References Cited

U.S. PATENT DOCUMENTS

| | | | |
|---|---|---|---|
| 1,640,591 | 8/1927 | Borneman . | |
| 3,324,799 | 6/1967 | Terrano . | |
| 3,658,444 | 4/1972 | Rhodes et al. . | |
| 3,685,287 | 8/1972 | Dooley | 415/55.2 |
| 3,694,101 | 9/1972 | Rumsey | 415/55.6 |
| 3,720,372 | 3/1973 | Jacobs . | |
| 4,678,395 | 7/1987 | Schweinfurter . | |
| 4,854,830 | 8/1989 | Kozawa et al. | 415/55.1 |
| 4,872,806 | 10/1989 | Yamada et al. | 415/55.5 |

FOREIGN PATENT DOCUMENTS

| | | | |
|---|---|---|---|
| 2104495 | 5/1979 | Fed. Rep. of Germany . | |
| 59-211791 | 11/1984 | Japan | 415/55.6 |
| 190191 | 8/1986 | Japan | 415/55.6 |
| 495452 | 12/1975 | U.S.S.R. . | |
| 2036178 | 6/1980 | United Kingdom . | |

*Primary Examiner*—Edward K. Look
*Assistant Examiner*—Miachael S. Lee
*Attorney, Agent, or Firm*—David B. Kelley; Roger L. May

[57] ABSTRACT

An automotive fuel pump has a pump housing encasing a rotary pumping element which forms two non-communicating chambers comprising an inlet chamber in communication with a fuel inlet and an outlet pumping chamber in communication with a fuel outlet. The rotary pumping element has a ring portion along an outer circumference, a plurality of vanes around an inner circumference radially inward of the ring portion, and a plurality of axially extending fuel flow passages located radially between the plurality of vanes and the ring portion. Fuel passes from the fuel inlet to the outlet pumping chamber and from the inlet pumping chamber to the fuel outlet through the fuel flow passages in the rotary pumping element.

20 Claims, 2 Drawing Sheets

AUTOMOTIVE FUEL PUMP HOUSING WITH ROTARY PUMPING ELEMENT

FIELD OF THE INVENTION

This invention relates to automotive fuel pumps, and, in particular, to a fuel pump housing and rotary pumping element which combine to form two pumping chambers for reducing the tolerances required in manufacturing and for minimizing crossing losses.

BACKGROUND OF THE INVENTION

Conventional tank-mounted automotive fuel pumps typically have a rotary pumping element, 118 encased within a pump housing, 120, as shown in FIGS. 2 and 3. Fuel flows into pumping chamber 124 within pump housing 120 and the rotary pumping action of vanes 126 and vane grooves 128 of rotary pumping element 118 produces vortices 132. Vanes 126 do not, however, extend to the top, 130, of pumping chamber 124 and fuel crosses between sides 134 and 136 resulting in crossing losses which decrease pump efficiency.

An additional problem with conventional fuel pump designs is the need for stripper portion 122 in pump housing 120 (FIG. 2). As fuel is propelled by rotary pumping element 118 from the fuel inlet (not shown) to the fuel outlet (not shown), fuel pressure increases. Since the fuel inlet and fuel outlet are nearly circumferentially adjacent, stripper portion 122 must be closely toleranced with respect to rotary pumping element 118 so as to separate low pressure region 110 from high pressure region 112 near the inlet and outlet, respectively, without undue losses. Stripper portion 122 increases the manufacturing cost because close tolerancing is required.

SUMMARY OF THE INVENTION

The present invention provides a more efficient fuel pump which minimizes crossing losses within the pumping chamber by separating the pumping chamber into two non-communicating chambers and which reduces manufacturing costs by providing a rotary pumping element having an outer ring portion which eliminates the need for a stripper. This is accomplished by providing a fuel pump for supplying fuel from a fuel tank to an automotive engine, with the fuel pump comprising a pump casing and a motor mounted within the casing and having a shaft extending therefrom. A rotary pumping element, which is fitted to the shaft, has a ring portion along an outer circumference thereof, a plurality of vanes around an inner circumference radially inward of the ring portion, and a plurality of axially extending fuel flow passages located radially between the plurality of vanes and the ring portion. A pump housing, which is mounted within the pump casing and has a fuel inlet and a fuel outlet therethrough, encases the rotary pumping element therein such that two non-communicating pumping chambers are formed along the periphery of the rotary pumping element.

The two non-communicating pumping chambers comprise an inlet pumping chamber in communication with the fuel inlet and an outlet pumping chamber in communication with the fuel outlet, with fuel passing from the fuel inlet to the outlet pumping chamber and from the inlet pumping chamber to the fuel outlet through the fuel flow passages in the rotary pumping element.

Thus, an object of the present invention is to provide a fuel pump housing and rotary pumping element design which eliminates the need for machining the pump bottom of a pump housing or for providing a barrier between the high and low pressure regions of the pumping chamber.

A further object of the present invention is to provide a fuel pump having two non-communicating pumping chambers for minimizing crossing losses within the pump housing.

Yet another object of the present invention is to simplify manufacture of a fuel pump housing by providing a rotary pumping element having an outer ring portion which fits snugly within the pump bottom of the pump housing so that the pump bottom does not require a stripper portion.

DETAILED DESCRIPTION OF THE PREFERRED EMBODIMENT

Figure 1:
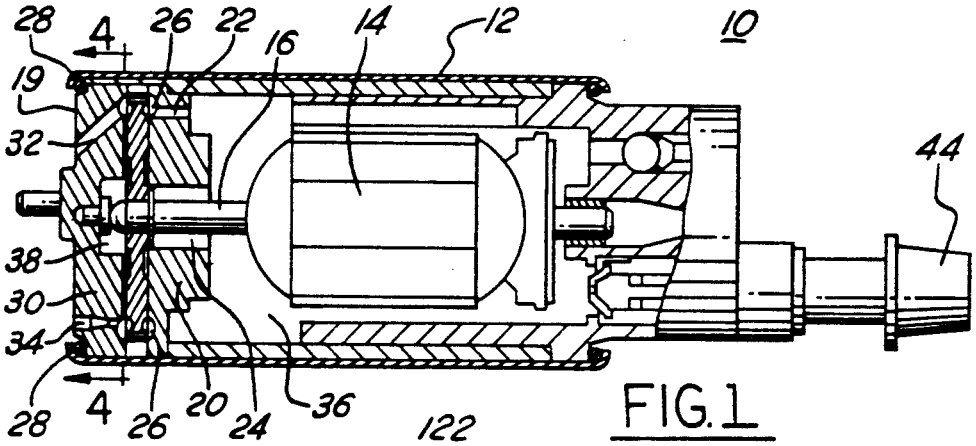
FIG. 1 is a cross-sectional view of a fuel pump according to the present invention.
Figure 2:
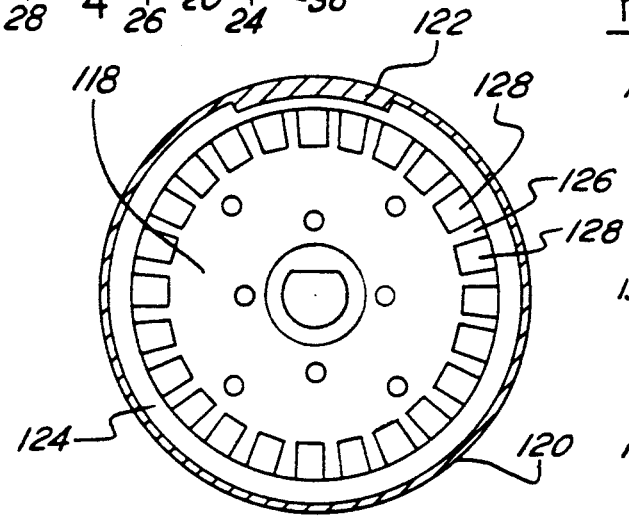
(PRIOR ART) FIG. 2
FIG. 2 is a sectional view, partly broken away, of a prior art rotary pumping element within a fuel pump housing showing a stripper portion for separating high pressure and low pressure areas of the pumping chamber.
Figure 3:
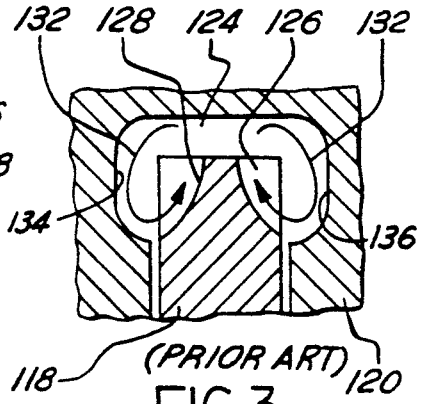
(PRIOR ART) FIG. 3
FIG. 3 is a cross-sectional view of a prior art pumping chamber showing the shape of the flow channels in the top and bottom portions of the pump housing.
Figure 10:
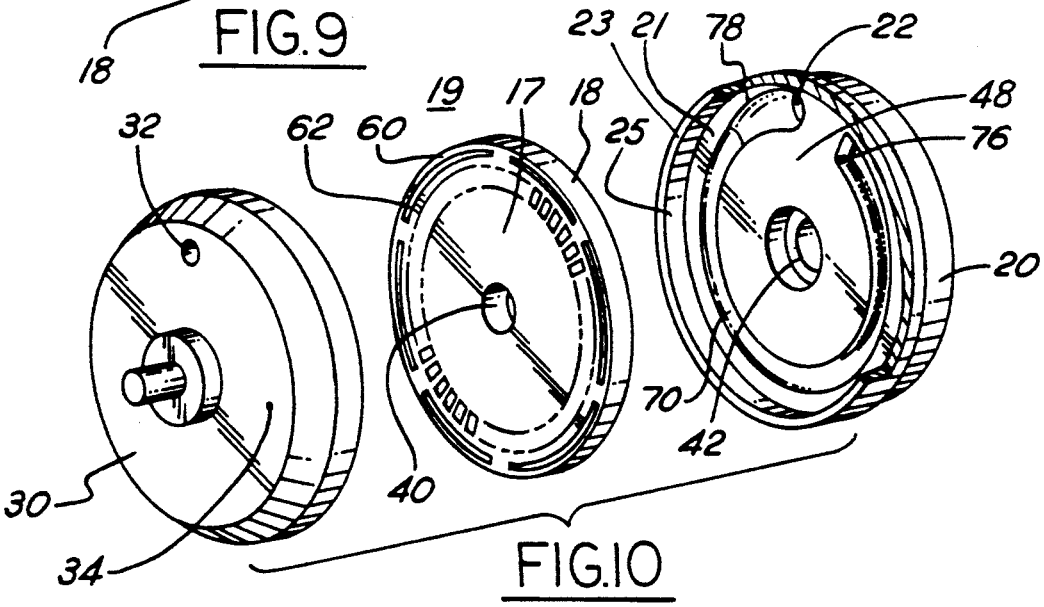
FIG. 10 is perspective view of a pump housing and rotary pumping element according to the present invention showing a pump cover and a pump bottom which comprise the pump housing.

Referring now to FIG. 1, fuel pump 10 has casing 12 for containing motor 14, preferably an electric motor, which is mounted within motor space 36. Motor 14 has shaft 16 extending therefrom in a direction from fuel pump outlet 44 to fuel inlet 32. Rotary pumping element 18, preferably an impeller, or, alternatively, a regenerative turbine, is fitted on shaft 16 and encased within pumping section 19, which preferably is composed of pump bottom 20 and pump cover 30, as shown in FIG. 10. Rotary pumping element 18 has a central axis which is coincident with the axis of shaft 16 (FIG. 1). Shaft 16 passes through shaft opening 40 of rotary pumping element 18 and into cover recess 38 of pump cover 30. As seen in FIG. 1, shaft 16 is journalled within bearing 24. Pump bottom 20 has fuel outlet 22 leading from a pumping chamber 26 formed along the periphery of rotary pumping element 18. Pressurized fuel is discharged through fuel outlet 22 to motor space 36 and cools motor 14 while passing over it to fuel pump outlet 44.

Figure 4:
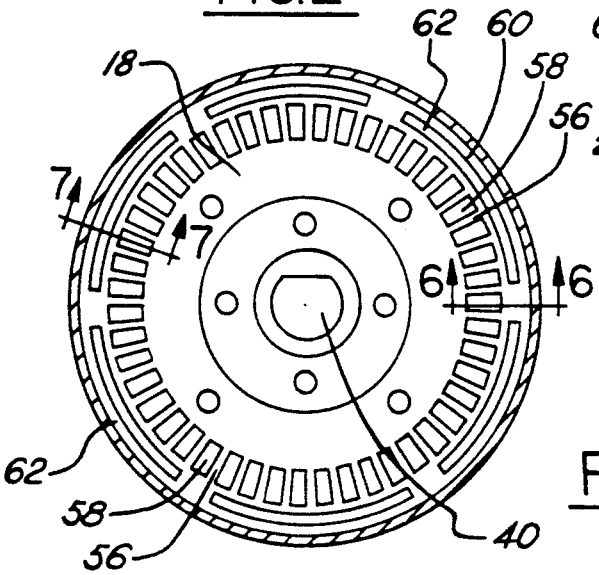
FIG. 4 is a sectional view, partly broken away, of a rotary pump according to the present invention.

FIGS. 4 and 10 show the preferred embodiment of rotary pumping element 18 of the present invention. Rotary pumping element 18 has an outer ring portion 60 radially along an outer circumference thereof which mates with annular inner ledge 21 of pump bottom 20 (FIG. 10). Housing mating face 17 of rotary pumping element 18 thus will be flush, in a perpendicular direction to the axis of shaft 16, with annular outer ledge 23 within shoulder 25 of pump bottom 20. A plurality of vanes 56 extend around an inner circumference of rotary pumping element 18 radially inward of outer ring portion 60 (FIG. 4). Circumferentially adjacent to vanes 56 are vane grooves 58 preferably having a semicircular shape which, as discussed below, approximates the shape of fuel flow vortices within pumping section 19.

Figure 7:
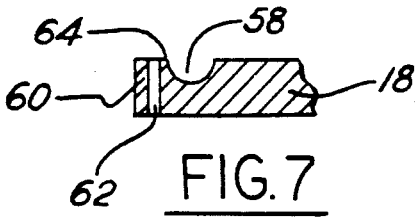
FIG. 7 is view taken along line 7—7 of FIG. 4 showing vane, fuel flow passage and vane groove detail of a rotary pumping element according to the present invention.

Radially between outer ring portion 60 and vanes 56 are a plurality of fuel flow passages 62, preferably arcuate slots, which extend through rotary pumping element 18 parallel to the axis of shaft 16 (FIG. 7). Flow passages 62 preferably have a radial width of one-half or greater than the radial length of a vane 56. The circumferential length of flow passages 62 is preferably equal to or less than the circumferential distance, in a perspective along an axis parallel to shaft 16, between fuel inlet 32 and fuel outlet 22.

Rotary pumping element 18 is preferably integrally molded out of a plastic material, such as phenolic, acetyl or other plastic or non-plastic materials known to those skilled in the art and suggested by this disclosure. Alternatively, rotary pumping element 18 can be die cast in aluminum or steel.

Figure 5:
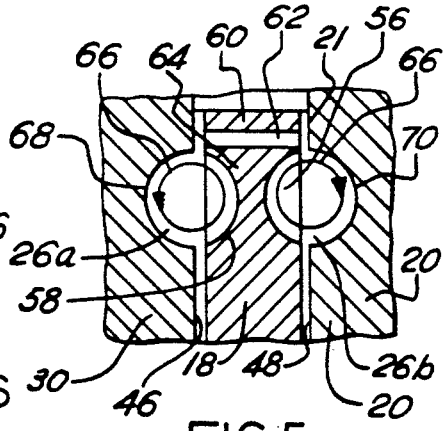
FIG. 5 is a cross-sectional view of a portion of a pump according to the present invention showing non-communicating pumping chambers in the top and bottom portions of the pump housing.
Figure 6:
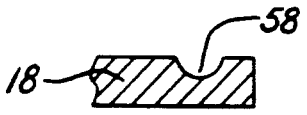
FIG. 6 is view taken along line 6—6 of FIG. 4 showing vane and vane groove detail of a rotary pumping element according to the present invention.
Figure 11:
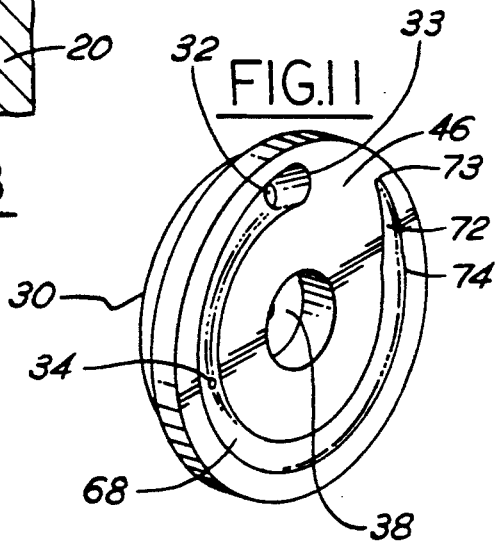
FIG. 11 is a perspective view of the rotary pumping element mating face of a pump cover according to the present invention showing an annular pumping channel which converges and bends radially outward toward one circumferential end.

In order to minimize the crossing losses previously discussed, two non-communicating pumping chambers **26*a* and 26*b* are formed on opposite sides of rotary pumping element 18 as shown in FIG. 5. Annular cover channel 68 and annular bottom channel 70, which cooperate with vane grooves 58 to form pumping chambers 26*a* and 26*b*, respectively, are fashioned circumferentially along a radially outward portion of rotary pumping element mating surfaces 46 and 48 of pump cover 30 and pump bottom 20, respectively, as shown in FIGS. 10 and 11**.

Rotary pumping element 18 mates with mating face 46 on the side adjacent pump cover 30 and with inner ledge 21 of pump bottom 20 to prevent fuel from flowing between pumping chambers **26*a* and 26*b* (FIG. 5). Preferably, rotary pumping element 18 has an inner ring portion 64 radially disposed between vanes 56 and fuel flow passages 62 to prevent fuel from flowing between inlet pumping chamber 26*a* and outlet pumping chamber 26*b*. Additionally, it is preferable for inlet pumping chamber 26*a* and outlet pumping chamber 26*b* to have circular shaped cross-sections, as shown in FIG. 5, which approximate the shape of primary vortices 66** and which prevent secondary counterflowing vortices from forming.

With the rotary pumping element 18 and pumping section 19 just described, pump bottom 20 is more easily manufactured since there is no need for the stripper portion previously discussed. Thus, the exactness in tolerancing necessary of prior art rotary pumping elements is no longer required since rotary pumping element 18 of the present invention has outer ring portion 62 which fits snugly within shoulder 25 of pump bottom 20.

Figure 8:
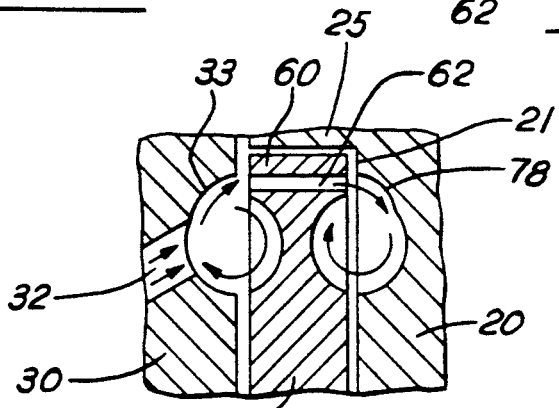
FIG. 8 is a cross-sectional view of a portion of a pump according to the present invention showing fuel flow from the fuel inlet to the outlet pumping chamber of the pump housing.

In operation, fuel is drawn from a fuel tank (not shown), in which pump 10 may be mounted, through fuel inlet 32 in pump cover 30, and into pumping chambers **26*a* and 26*b* by the rotary pumping action of rotary pumping element 18 (FIG. 8). As rotary pumping element 18 rotates, fuel flow passages 62 intermittently provide a path for fuel to flow from a flared section 33 of inlet pumping chamber 26*a* to a flared section 76 of outlet pumping chamber 26*b* axially aligned with fuel inlet 32 (FIG. 10**).

Figure 9:
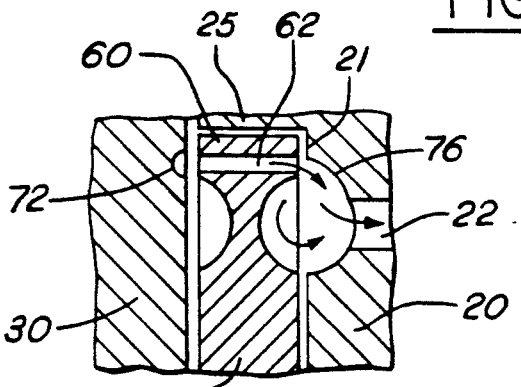
FIG. 9 is a cross-sectional view of an outlet portion of a pump according to the present invention showing fuel flow from a narrower and shallower offset section of the inlet pumping chamber to the fuel outlet of the pump housing.

The rotary pumping action of vanes 56 on rotary pumping element 18 propels primary vortices 66 circumferentially around annular pumping chambers **26*a* and 26*b* (FIG. 5). Fuel flow from pump housing 19 to motor space 36 is accomplished as shown in FIG. 9. Fuel flow passages 62 intermittently provide a path for fuel to flow from a narrower and shallower transition section 72 of inlet pumping chamber 26*a* to a flared section 78 of outlet pumping chamber 26*b* axially aligned with transition section 72 and adjacent fuel outlet 22. Fuel from outlet pumping chamber 26*b* is exhausted through fuel outlet 22**.

Transition section 72 of pump cover 30 preferably extends along an angle of approximately 15°–25° in which the depth of cover channel 68, as measured from the center of cover channel 68 to rotary pumping element mating face 46 of pump cover 30, gradually decreases until cover channel 68 is flush with mating face 46 at cover channel end 73. Cover face 46 mates with rotary pumping element 18 when pump cover 30 and pump bottom 20 are combined. Cover channel 68 depth is approximately 0.5 to 2.0 mm from fuel inlet 32 to a transition beginning point 74 of transition section 72. The width of cover channel 68 gradually narrows to a point at cover channel end 73. This gradual convergence of cover channel 68 provides a smooth path for vortices 66 to migrate toward fuel outlet 22 without the cross-over losses inherent in fuel flow channels axially adjacent the fuel outlet Cover channel 68 extends approximately 285°–295° from fuel inlet 32 to transition beginning point 74 (FIG. 11).

As seen in FIG. 1, a purge orifice 34 extends axially through pump cover 30 to bleed fuel vapor from pumping chamber **26*a* so that vaporless liquid fuel reaches the engine (not shown). Fuel vapor passes from pumping chamber 26*a*, through purge orifice 34, and into the fuel tank (not shown). Preferably, purge orifice 34 is located at a radially inward portion of cover channel 68 approximately 100°–120° from fuel inlet 32 as shown in FIG. 11**.

Cover channel 68 and bottom channel 70 can be die cast along with pump bottom 20 and pump cover 30, preferably in aluminum, or can be machined into pump bottom 20 and pump cover 30. Alternatively, cover channel 68 and bottom channel 70 can be integrally molded together with pump bottom 20 and pump cover 30 out of a plastic material, such as acetyl or other plastic or non-plastic materials known to those skilled in the art and suggested by this disclosure.

Although the preferred embodiment of the present invention has been disclosed, various changes and modifications may be made without departing from the scope of the invention as set forth in the appended claims.

We claim:

1. A fuel pump for supplying fuel from a fuel tank to an automotive engine, comprising:

a pump casing;

a motor mounted within said casing and having a shaft extending therefrom;

a rotary pumping element fitted to said shaft having a ring portion along an outer circumference thereof, a plurality of vanes around an inner circumference radially inward of said ring portion, and a plurality of axially extending fuel flow passages located radially between said plurality of vanes and said ring portion; and a pump housing mounted within said pump casing and having a fuel inlet and a fuel outlet therethrough, said pump housing encasing said rotary pumping element therein such that two axially spaced pumping chambers connected in series by said flow passages are formed along the periphery of said rotary pumping element.

2. A fuel pump according to claim 1 wherein said non-communicating pumping chambers comprise an inlet pumping chamber in communication with said fuel inlet and an outlet pumping chamber in communication with said fuel outlet, with fuel passing from said fuel inlet to said outlet pumping chamber and from said inlet pumping chamber to said fuel outlet through said fuel flow passages in said rotary pumping element.

3. A fuel pump according to claim 1 wherein said rotary pumping element has an inner ring portion located radially between said vanes and said flow passages for separating said two non-communicating pumping chambers.

4. A fuel pump according to claim 1 wherein said plurality of flow passages comprise arcuate slots with a radial width of one-half or greater than the radial length of one of said plurality of vanes.

5. A fuel pump according to claim 1 wherein said plurality of vanes are separated by a plurality of semicircular shaped vane grooves.

6. A fuel pump according to claim 1 wherein said rotary pumping element comprises a regenerative impeller.

7. A fuel pump for supplying fuel from a fuel tank to an automotive engine, comprising:

a pump casing;

a motor mounted within said casing and having a shaft extending therefrom;

a pump bottom mounted within said casing having a pump outlet therethrough and an annular bottom channel formed along an outer circumference thereof;

a rotary pumping element fitted to said shaft having a ring portion along an outer circumference of said pumping element, a plurality of vanes around an inner circumference radially inward of said ring portion, and a plurality of axially extending fuel flow passages located radially between said plurality of vanes and said ring portion; and a pump cover having an annular cover channel along an outer circumference and a fuel inlet therethrough, said pump cover mounted on an end of said casing and to said pump bottom with said rotary pumping element therebetween such that said pump cover, said rotary pumping element, and said pump bottom cooperate to form a pump housing having two axially spaced pumping chambers connected in series by said flow passages along the periphery of said rotary pumping element.

8. A fuel pump according to claim 7 wherein said non-communicating pumping chambers comprise an inlet pumping chamber in communication with said fuel inlet and an outlet pumping chamber in communication with said fuel outlet, with fuel passing from said fuel inlet to said outlet pumping chamber and from said inlet pumping chamber to said fuel outlet through said fuel flow passages in said rotary pumping element.

9. A fuel pump according to claim 7 wherein said rotary pumping element has an inner ring portion located radially between said vanes and said flow passages for separating said two non-communicating pumping chambers.

10. A fuel pump according to claim 7 wherein said plurality of flow passages comprise arcuate slots with a radial width of one-half or greater than the radial length of one of said plurality of vanes.

11. A fuel pump according to claim 7 wherein said cover channel and said bottom channel have semi-circular shaped cross-sections.

12. A fuel pump according to claim 7 wherein said plurality of vanes are separated by a plurality of semicircular shaped vane grooves.

13. A fuel pump according to claim 7, wherein a purge orifice extends axially through said pump cover from a radially inward portion of said annular flow channel of said pump cover for expelling fuel vapor from said pump chamber, said purge orifice positioned at approximately 100°-120° circumferentially counterclockwise from the center of said pump inlet.

14. A fuel pump according to claim 7 wherein said rotary pumping element comprises a regenerative turbine.

15. A fuel pump according to claim 7 wherein said cover channel extends circumferentially from said pump inlet to a transition section in which the width and depth of said cover channel gradually become narrower and shallower, respectively, such that said cover channel becomes flush with a rotary pumping element mating face of said pump cover and communicates partially with said pump outlet.

16. A fuel pump for supplying fuel from a fuel tank to an automotive engine, comprising:

a pump casing;

a motor mounted within said casing and having a shaft extending therefrom;

a pump bottom mounted within said casing having a pump outlet therethrough and an annular bottom channel formed along an outer circumference thereof;

a rotary pumping element fitted to said shaft having a ring portion along an outer circumference of said pumping element, a plurality of vanes around an inner circumference radially inward of said ring portion, and a plurality of axially extending fuel flow passages located radially between said plurality of vanes and said ring portion; and a pump cover having an annular cover channel along an outer circumference and a fuel inlet therethrough, said pump cover mounted on an end of said casing and to said pump bottom with said rotary pumping element therebetween such that said pump cover, said rotary pumping element, and said pump bottom cooperate to form a pump housing having two axially spaced pumping chambers connected in series by said flow passages along the periphery of said rotary pumping element, and wherein said non-communicating pumping chambers comprise an inlet pumping chamber in communication with said fuel inlet and an outlet pumping chamber in communication with said fuel outlet, with fuel passing from said fuel inlet to said outlet pumping chamber and from said inlet pumping chamber to said fuel outlet through said fuel flow passages in said rotary pumping element.

17. A fuel pump according to claim 16 wherein said rotary pumping element has an inner ring portion located radially between said vanes and said flow passages for separating said two non-communicating pumping chambers.

18. A fuel pump according to claim 16 wherein said plurality of flow passages comprise arcuate slots with a radial width of less than or equal to one-third the radial length of one of said plurality of vanes.

19. A fuel pump according to claim 16 wherein said plurality of vanes are separated by a plurality of semicircular shaped vane grooves.

20. A fuel pump according to claim 16 wherein said cover channel extends circumferentially from said pump inlet to a transition section in which the width and depth of said cover channel gradually become narrower and shallower, respectively, such that said cover channel becomes flush with a rotary pumping element mating face of said pump cover and communicates partially with said pump outlet.

* * * * *